US011428095B2

(12) United States Patent
Jung et al.

(10) Patent No.: US 11,428,095 B2
(45) Date of Patent: Aug. 30, 2022

(54) FLUID INFLOW SENSING IN A WELLBORE AND RELATED SYSTEMS AND METHODS

(71) Applicant: Baker Hughes Oilfield Operations LLC, Houston, TX (US)

(72) Inventors: Sebastian Jung, Isernhagen (DE); Thomas Kruspe, Wietzendorf (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 16/814,072

(22) Filed: Mar. 10, 2020

(65) Prior Publication Data

US 2021/0285319 A1 Sep. 16, 2021

(51) Int. Cl.

| | |
|---|---|
| ***E21B 47/107*** | (2012.01) |
| ***E21B 7/06*** | (2006.01) |
| ***E21B 47/07*** | (2012.01) |
| *E21B 21/08* | (2006.01) |

(52) U.S. Cl.

CPC ..... *E21B 47/107* (2020.05); *E21B 7/06* (2013.01); *E21B 47/07* (2020.05); *E21B 21/085* (2020.05)

(58) Field of Classification Search

CPC ..... E21B 44/00; E21B 47/00; E21B 47/10; E21B 47/107; E21B 47/103; E21B 47/12

See application file for complete search history.

(56) References Cited

U.S. PATENT DOCUMENTS

| | | | | |
|---|---|---|---|---|
| 6,216,533 | B1 | 4/2001 | Woloson et al. | |
| 2004/0003658 | A1 | 1/2004 | Han et al. | |
| 2009/0272578 | A1 | 11/2009 | MacDonald | |
| 2012/0298421 | A1 | 11/2012 | Coates et al. | |
| 2013/0167628 | A1* | 7/2013 | Hull | E21B 47/117 73/152.58 |
| 2016/0258281 | A1* | 9/2016 | Mandal | E21B 47/005 |
| 2017/0269243 | A1* | 9/2017 | Jagannathan | G01V 1/288 |
| 2017/0342818 | A1 | 11/2017 | Roberson et al. | |
| 2018/0135365 | A1* | 5/2018 | Knudsen | E21B 21/08 |
| 2018/0252093 | A1* | 9/2018 | Cramm | E21B 47/07 |
| 2019/0203586 | A1 | 7/2019 | Livescu et al. | |

FOREIGN PATENT DOCUMENTS

| | | | |
|---|---|---|---|
| DE | 102014003552 | A1 | 9/2015 |
| EP | 2423712 | A2 | 2/2012 |
| WO | 2014/009066 | A1 | 6/2014 |

OTHER PUBLICATIONS

International Search Report for International Application No. PCT/US2021/021455 dated Jun. 28, 2021 dated Jun. 28, 2021, 3 pages.

International Written Opinion for International Application No. PCT/US2021/021455 dated Jun. 28, 2021 dated Jun. 28, 2021, 6 pages.

* cited by examiner

*Primary Examiner* — Tara Schimpf
(74) *Attorney, Agent, or Firm* — TraskBritt

(57) ABSTRACT

A system and method for determining fluid inflow into a wellbore. The system may include a drill string including an earth-boring tool. The drill string may further include a first array of sensors arranged radially about the drill string in a region of the drill string after the earth-boring tool. The drill string may be configured to be inserted into the wellbore and the first array of sensors may be configured to detect an inflow of fluid into the wellbore through a change in an environmental property of the wellbore.

20 Claims, 6 Drawing Sheets

FLUID INFLOW SENSING IN A WELLBORE AND RELATED SYSTEMS AND METHODS

TECHNICAL FIELD

Embodiments of the present disclosure generally relate to earth-boring operations. In particular, embodiments of the present disclosure relate to fluid inflow sensing on a drill string.

BACKGROUND

Earth-boring operations may include drilling a wellbore in a formation using an earth-boring tool coupled to a drill string. Earth-boring operations may be used to extract fluid from the formation, such as oil, natural gas, water, geothermal gases, etc. In conventional drilling operations the pressure in the wellbore may be maintained at a higher pressure than the surrounding formation pressure such that fluid ingress into the wellbore may be substantially prevented by the pressure differential.

Some drilling operations may include low pressure drilling operations. Such drilling operations are often referred to as "underbalanced" drilling. In underbalanced drilling operations, the pressure in the wellbore may be maintained below the fluid pressure in the surrounding formations. Drilling at a lower pressure may enable the fluid from the surrounding formation to enter the wellbore for extraction to the surface. Underbalanced drilling operations may involve the use of a seal at the surface of the formation configured to divert formation fluids from the drilling operation, thereby enabling the earth-boring tool to continue drilling as formation fluid flows from the wellbore. Underbalanced drilling may minimize damage to the formation and increase a rate of penetration by reducing the pressure downhole near the earth-boring tool.

BRIEF SUMMARY

Some embodiments of the present disclosure include a drill string. The drill string may include an earth-boring tool. The drill string may further include a first array of acoustic sensors arranged radially about the drill string in a region of the drill string above the earth-boring tool. The drill string may be configured to be inserted into a wellbore, and the first array of acoustic sensors may be configured to detect an inflow of fluid into the wellbore from a subterranean formation.

Another embodiment of the present disclosure may include an earth-boring system. The earth-boring system may include a drill string. The earth-boring system may further include an earth-boring tool coupled to the dill string. The earth-boring system may also include an array of temperature sensors coupled to the drill string. The earth-boring system may further include a computing device configured to receive sensor readings from the array of temperature sensors. The earth-boring tool and the drill string may be configured to be inserted into a wellbore and the computing device may be configured to determine fluid inflow into a wellbore responsive to the sensor readings from the array of temperature sensors.

Another embodiment of the present disclosure may include method of forming a wellbore in a subterranean formation. The method may include advancing a drill string into a wellbore, the drill string comprising an array of sensors coupled to the drill string. The method may also include detecting fluid inflow into a wellbore through a change in one or more properties of the wellbore environment detected using the array of sensors coupled to the drill string. The method may further include determining a radial position of the fluid inflow into the wellbore using the array of sensors coupled to the drill string. The method may also include steering the drill string in a direction toward the radial position of the fluid inflow into the wellbore.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular earth-boring system or component thereof, but are merely idealized representations employed to describe illustrative embodiments. The drawings are not necessarily to scale.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

As used herein, the term "fluid" may mean and include fluids of any type and composition. Fluids may take a liquid form, a gaseous form, or combinations thereof, and, in some instances, may include some solid material suspended therein. In some embodiments, fluids may convert between a liquid form and a gaseous form during a cooling or heating process as described herein. In some embodiments, the term fluid includes gases, liquids, and/or pumpable mixtures of liquids and solids.

As used herein, the terms "behind" and "ahead" when used in reference to a component of a drill string or casing string refer to a direction relative to the motion of the component of the drill string. For example, if the component is moving into a borehole a bottom of the borehole is ahead of the component and the surface and the drill rig are behind the component.

Figure 1:
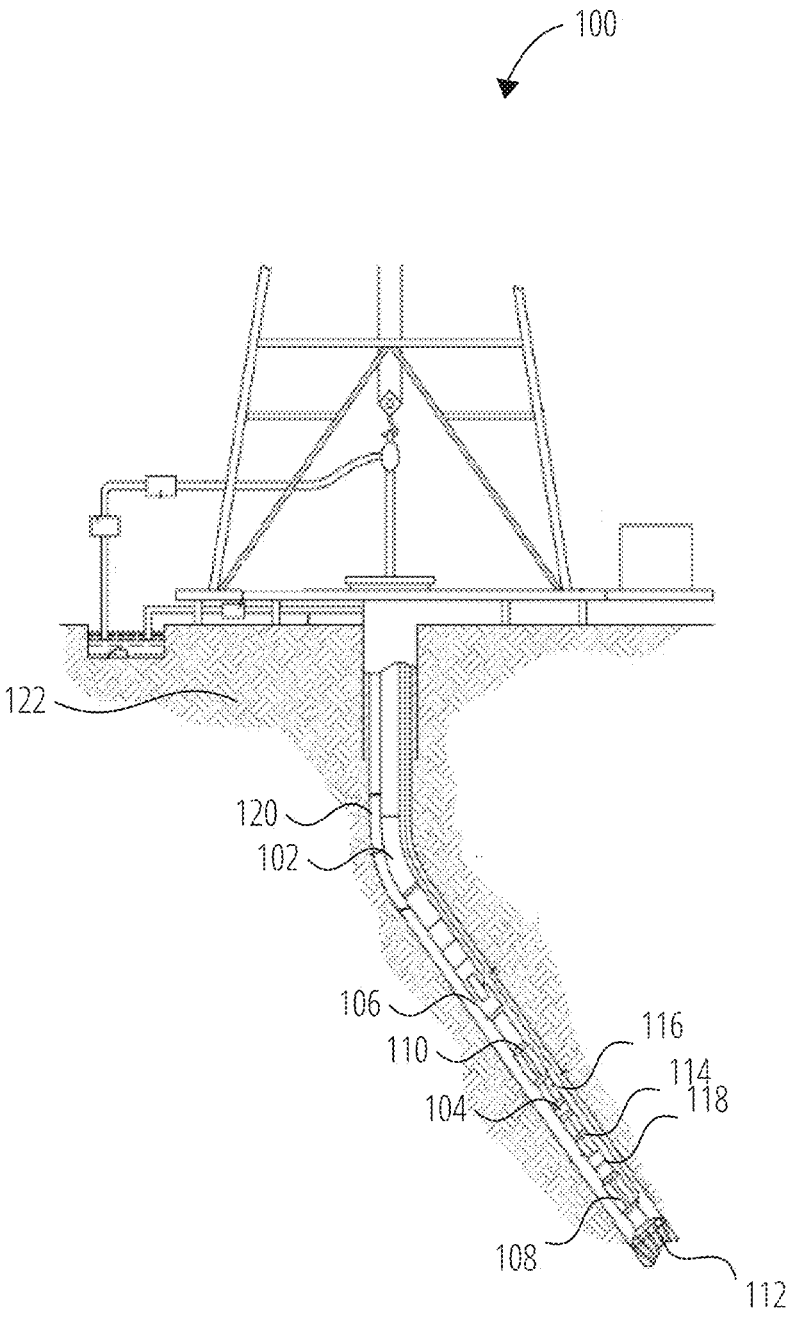
FIG. 1 illustrates an earth-boring system in accordance with an embodiment of the present disclosure.

FIG. 1 illustrates an earth-boring system 100. An earth-boring system 100 may include a drill string 102. In some embodiments, the drill string 102 may include multiple sections of drill pipe coupled together to form a long string of drill pipe. In some embodiments, the drill string 102 may include a substantially continuous length of tubing extending from a coil of tubing at the surface. A forward end of the drill string 102 may include a bottom hole assembly 104 (BHA). The BHA 104 may include components, such as a motor, 106 (e.g., mud motor), one or more reamers 108 and/or stabilizers 110, and an earth-boring tool 112 such as a drill bit. The BHA 104 may also include electronics, such as sensors 114, modules 116, and/or tool control components 118. The drill string 102 may be inserted into a wellbore 120. The wellbore 120 may be formed by the earth-boring tool 112 as the drill string 102 proceeds through a formation 122. The tool control components 118 may be configured to control an operational aspect of the earth-boring tool 112. For example, the tool control components 118 may include a steering component configured to change an angle of the earth-boring tool 112 with respect to the drill string 102 changing a direction of advancement of the drill string 102. The tool control components 118 may be configured to receive instructions from an operator at the surface and perform actions responsive to the instructions. In some embodiments, control instructions may be derived downhole within the tool control components 118, such as in a closed loop system, etc.

The sensors 114 may be configured to collect information regarding the downhole conditions such as temperature, pressure, vibration, fluid density, fluid viscosity, cutting density, cutting size, cutting concentration, etc. In some embodiments, the sensors 114 may be configured to collect information regarding the formation, such as formation composition, formation density, formation geometry, etc. In some embodiments, the sensors 114 may be configured to collect information regarding the earth-boring tool 112, such as tool temperature, cutter temperature, cutter wear, weight on bit (WOB), torque on bit (TOB), string rotational speed (RPM), drilling fluid pressure at the earth-boring tool 112, fluid flow rate at the earth-boring tool 112, etc.

The information collected by the sensors 114 may be processed, stored, and/or transmitted by the modules 116. For example, the modules 116 may receive the information from the sensors 114 in the form of raw data, such as a voltage (e.g., 0-10 VDC, 0-5 VDC, etc.), an amperage (e.g., 0-20 mA, 4-20 mA, etc.), or a resistance (e.g., resistance temperature detector (RTD), thermistor, etc.). The module 116 may process raw sensor data and transmit the data to the surface on a communication network, using a communication network protocol to transmit the raw sensor data. The communication network may include, for example a communication line, mud pulse telemetry, electromagnetic telemetry, wired pipe, etc. In some embodiments, the modules 116 may be configured to run calculations with the raw sensor data, for example, calculating a viscosity of the drilling fluid using the sensor measurements such as temperatures, pressures or calculating a rate of penetration of the earth-boring tool 112 using sensor measurements such as cutting concentration, cutting density, WOB, formation density, etc.

In some embodiments, the downhole information may be transmitted to the operator at the surface or to a computing device at the surface. For example, the downhole information may be provided to the operator through a display, a printout, etc. In some embodiments, the downhole information may be transmitted to a computing device that may process the information and provide the information to the operator in different formats useful to the operator. For example, measurements that are outside a predetermined range may be provided in the form of alerts, warning lights, alarms, etc. Some information may be provided live in the form of a display, spreadsheet, etc., whereas other information that may not be useful until further calculations are performed may be processed and the result of the calculation may be provided in the display, print out, spreadsheet, etc.

In underbalanced drilling operations the productivity of the wellbore 120 may be correlated to the amount of the wellbore 120 that passes through a fluid producing portion of the formation 122. Thus determining where the fluid producing portions of the formation 122 are located and steering the drill string 102 toward the fluid producing portions of the formation 122 may increase the productivity of the wellbore 120. Many operations use imaging methods to determine porosity and/or permeability of the formation 122. However, conventional imaging methods may require a rotating sensor. In some embodiments, the drill string 102 may not be rotated during the drilling operation instead relying on the motor 106 to rotate the BHA 104. For example, Coiled Tubing (CT) drill strings may include a substantially continuous length of tubing beginning at a coil on the surface and extending between the surface and the BHA 104. A CT drill string may not be rotated from the surface in the same manner as a conventional drill string formed from connected lengths of pipe.

CT drill strings may be used in underbalanced drilling operations. For example, CT drill strings enable continuous drilling and pumping because drilling and pumping is not stopped to add lengths of pipe to the drill string 102. Continuous drilling and pumping may enable a substantially consistent pressure to be maintained downhole. Continuous drilling and pumping may also enable a higher rate of penetration (ROP) of the drill string 102. Because conventional imaging methods require a rotating sensor to image the formation 122, alternative methods may need to be incorporated into the drill string 102 to determine the porosity and/or permeability of the formation 122 without rotating the drill string 102.

Figure 2:
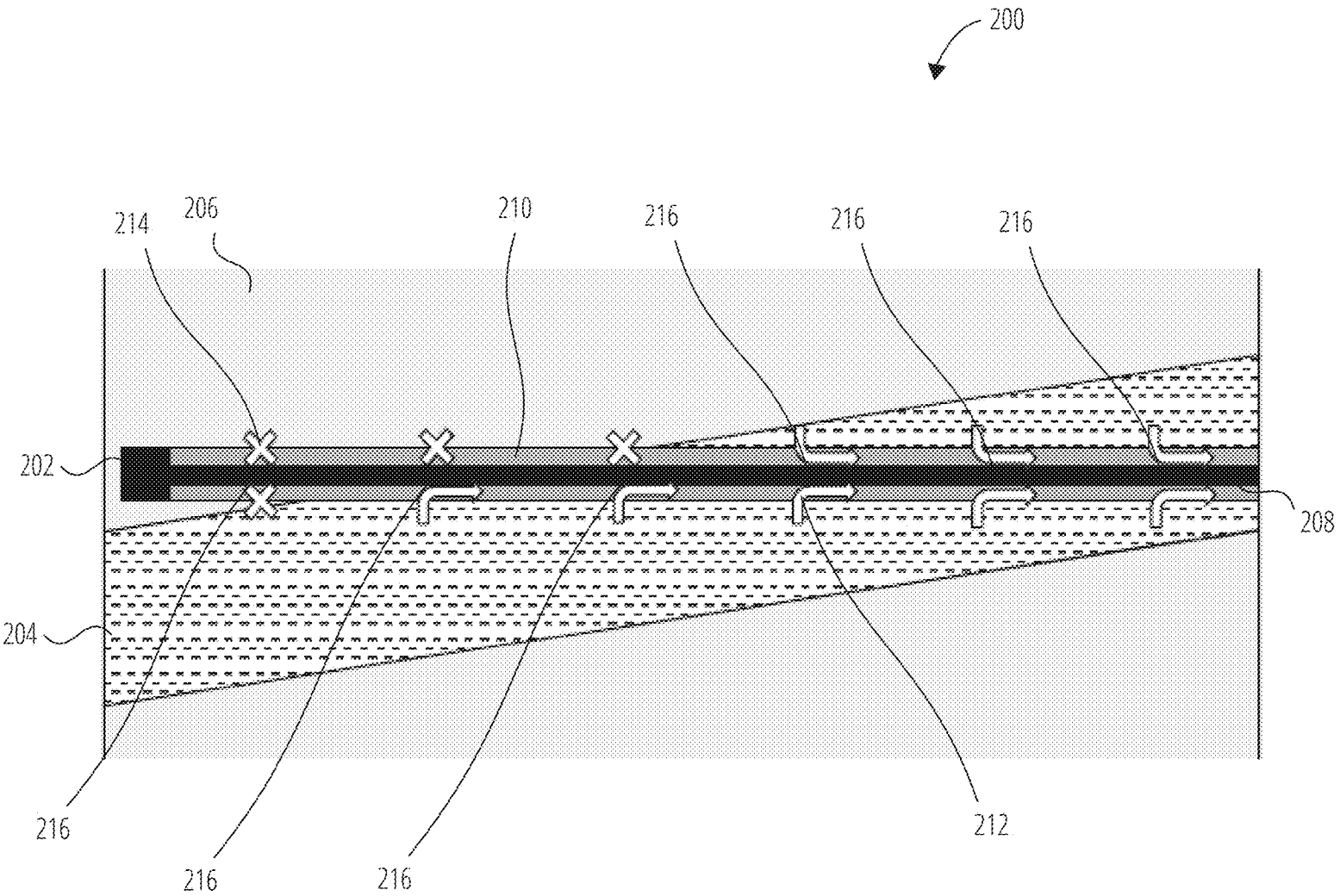
FIG. 2 illustrates a schematic view of a wellbore in a formation according to an embodiment of the present disclosure.

FIG. 2 illustrates a formation 200 having a drill string 208 and an earth-boring tool 202 forming a wellbore 210 through the formation 200. The formation 200 may include porous formation sections 204 and non-porous formation sections 206. The porous formation sections 204 may be permeable such that fluid within the porous formation sections 204 may flow through the porous formation sections 204 and into the wellbore 210. The non-porous formation sections 206 may be substantially impermeable, such that substantially no fluid passes through the non-porous formation sections 206 and into the wellbore 210. As described above, maximizing the portion of the wellbore 210 that lies within the porous formation sections 204 may increase the productivity of an underbalanced drilling operation.

The drill string 208 may include sensors arranged about the drill string 208 in arrays that may be configured to measure fluid inflow into the wellbore 210. In some embodiments, the arrays of sensors may be configured to determine a side of the drill string 208 where a fluid inflow region 212 into the wellbore 210 is located. For example, as the wellbore 210 enters the porous formation sections 204 from the non-porous formation sections 206 the fluid inflow region 212 may begin on a first side of the wellbore 210 while a second side of the wellbore 210 may be a fluid blockage region 214. The sensors may determine which side of the wellbore 210 is the fluid inflow region 212 and which side of the wellbore 210 is the fluid blockage region 214. The sensors may provide an indication of which side of the wellbore 210 is the fluid inflow region 212 such that the direction of travel of the drill string 208 may be adjusted toward the direction of the fluid inflow region 212 and away from the fluid blockage region 214.

In some embodiments, the drill string 208 may include multiple arrays of sensors. The sensor arrays may be positioned axially along the drill string 208 at different array locations 216. The array locations 216 may enable the different arrays of sensors to measure fluid inflow at different points along the drill string 208. In some embodiments, the array locations 216 may be substantially equal distances along the drill string 208. In some embodiments the array locations 216 may be concentrated within and/or near the BHA 104.

Figure 3:
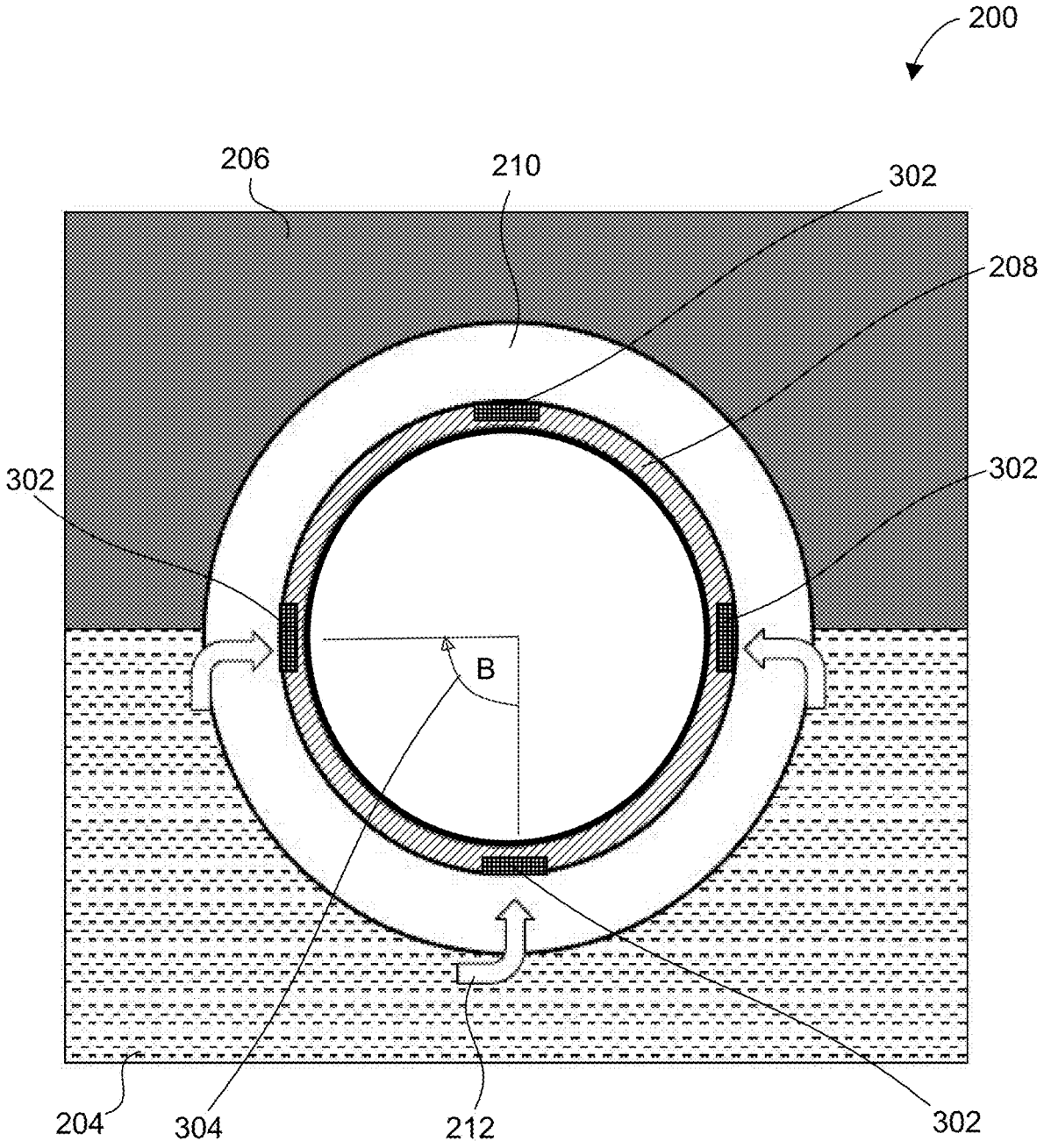
FIG. 3 illustrates a cross-sectional schematic view of a wellbore in a formation according to an embodiment of the present disclosure.

FIG. 3 illustrates an array of sensors 302 about the drill string 208 within the formation 200. As illustrated in FIG. 3, the wellbore 210 may include a fluid inflow region 212 extending about halfway around the outer surface of the wellbore 210 and a fluid blockage region 214 extending around the other portion of the outer surface of the wellbore 210. The drill string 208 may include one or more sensors 302. The sensors 302 may be radially spaced about the drill string 208.

In some embodiments, the spacing between each of the sensors 302 may be substantially equal. For example, an angle 304 of displacement between two adjacent sensors 302 may be substantially the same as a similar angle of displacement between any other adjacent sensors 302. As illustrated in FIG. 3, the drill string 208 may include four sensors 302. The angle 304 of displacement between each of the four sensors 302 may be about 90 degrees. In some embodiments, the drill string 208 may only include three sensors 302 and the angle 304 of displacement between each of the sensors 302 may be about 120 degrees. In some embodiments, the drill string 208 may include more than four sensors 302, such as between about four sensors 302 and about seventy-two sensors 302. Thus, the angle 304 of displacement between the sensors 302 may be between about 90 degrees and about 5 degrees.

In some embodiments, the sensors 302 may be positioned in a manner that minimizes a distance between the sensors 302 and a wall of the wellbore 210. For example, the sensors 302 may be positioned on an outer surface of the drill string 208. In some embodiments, the sensors 302 may be positioned on an outer portion of an earth-boring tool, such as ribs of a stabilizer, blades of a reamer, blades of a drill-bit, etc. Positioning the sensors 302 in a manner that minimizes a distance between the sensors 302 and the wall of the wellbore 210 may improve the accuracy of the sensors 302. For example, minimizing the distance between the sensors 302 and the wellbore 210 may reduce noise in the sensor signal, such as increasing the signal-to-noise ratio.

In some embodiments, the sensors 302 may be acoustic sensors. As fluid flows into the wellbore 210 from the porous formation sections 204, noise may be produced by the fluid flowing through the porous formation sections 204. For example, noise may be produced by flow passing through and/or over grains, flow passing through pore throats, reservoir fracture vibrations, etc. Reservoir fracture vibrations may be in the range of about 1 kilohertz (kHz) to about 5 kHz, such as between about 3 kHz and about 5 kHz. Regular flow through a porous formation may generate a noise between about 5 kHz and about 20 kHz, such as between about 7 kHz and about 15 kHz. Tighter formations (e.g., formations having small pores) may produce noise in the ultrasonic range, such as between about 20 kHz and about 30 kHz. In some cases, a permeable formation may have an extremely low permeability, such as less than about 1 millidarcy (md). A formation having a permeability less than about 1 md may substantially prevent liquid flow through the formation while allowing gas to continue to flow through the formation. Gas flow through the formation may generate noise in a wider range of frequencies including frequencies exceeding 30 kHz.

If one or more of the sensors 302 detects a noise above about 1 kHz, the detection of noise may indicate that fluid is flowing through the formation 200 and into the wellbore 210 in the region of the wellbore 210 nearest the sensors 302 detecting the noise. For example, FIG. 3 illustrates fluid inflow near three of the four sensors 302. Thus, the three sensors 302 may detect a noise associated with the fluid inflow. The sensors 302 may provide the raw data to a computing device, such as one of the modules 116 (FIG. 1), a surface controller, a control computer, an engineering computer, etc. The computing device may interpret the data from the sensors 302. The computing device may then determine that the region of the wellbore 210 nearest the three sensors 302 is the fluid inflow region 212. The module may further determine that the region of the wellbore 210 nearest the sensor 302 that does not detect a noise associated with the fluid inflow is a fluid blockage region 214.

In some embodiments, the computing device may be used for geo-steering the drill string 208. Geo-steering may include steering the drill string 208 responsive to the types of formation to position the drill string 208 and the wellbore 210 in the most beneficial portions of the formation, such as steering the drill string 208 to be fully encompassed by the porous formation sections 204. In some embodiments, the computing device may provide an operator with the locations of the fluid inflow region 212 and the fluid blockage region 214. The operator may use the information to redirect the drill string 208. For example, the operator may change a direction of the drill string 208 such that the drill string 208 moves toward the fluid inflow region 212 and away from the fluid blockage region 214. In some embodiments, the operator may steer the drill string 208 toward the fluid inflow region 212 until the one sensor 302 that was not detecting noise associated with the inflow of fluid begins to detect an inflow of fluid.

In some embodiments, the computing device may generate instructions and autonomously steer the drill string 208. For example, the computing device may determine the locations of the fluid inflow region 212 and the fluid blockage region 214. The computing device may then generate instructions for a steering apparatus of the drill string 208 to direct the drill string 208 in a direction toward the fluid inflow region 212 and away from the fluid blockage region 214. The computing device may continue to adjust a direction of the drill string 208 until the wellbore 210 is fully within the porous formation sections 204 as indicated by each of the sensors 302 detecting fluid inflow through the process described above.

Figure 4:
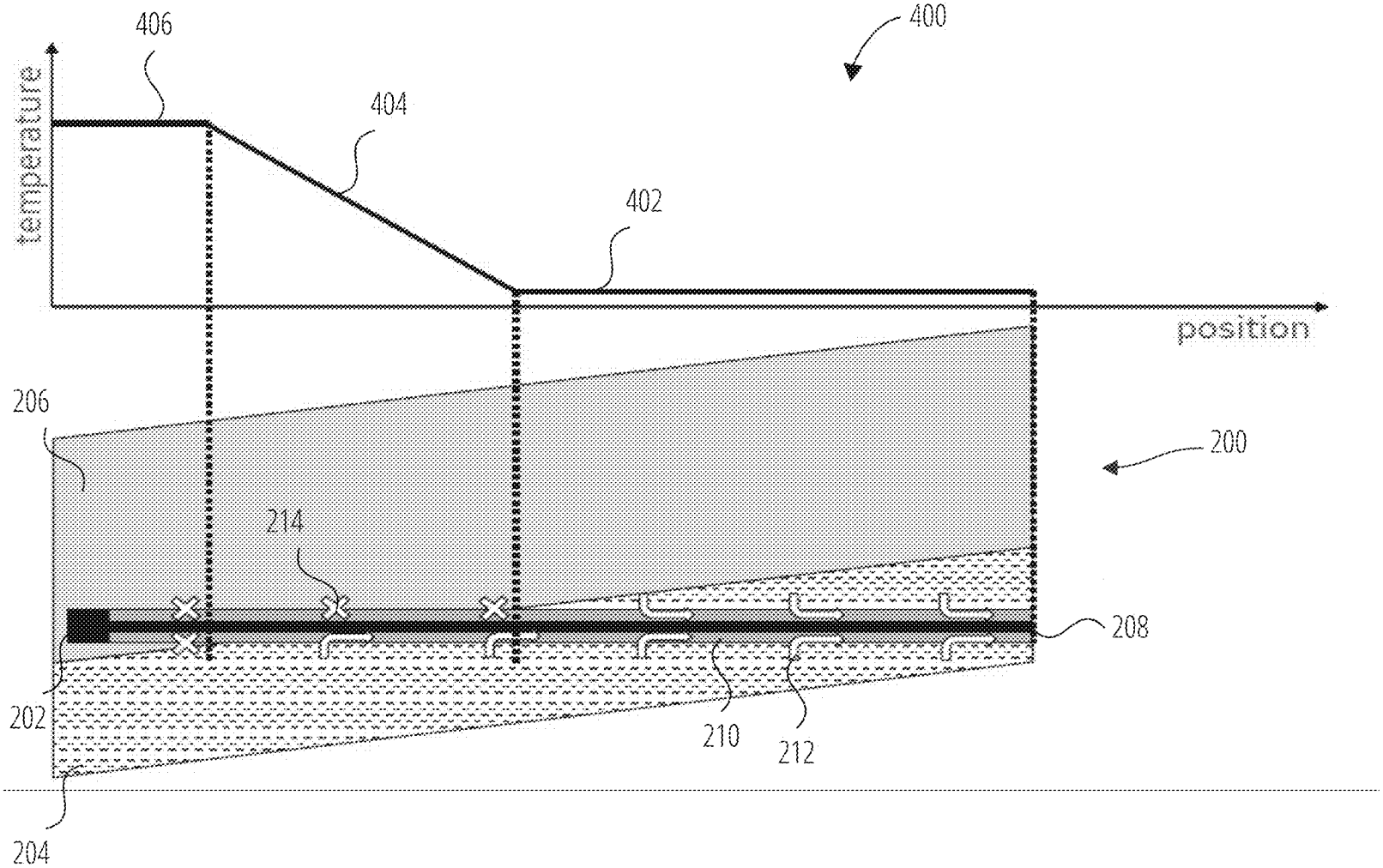
FIG. 4 illustrates a schematic view of a wellbore in a formation according to an embodiment of the present disclosure.

In some embodiments, the sensors 302 may be temperature sensors. FIG. 4 illustrates a temperature profile 400 of the wellbore 210 passing through the formation 200. As fluid flows into the wellbore 210 the fluid may cause local cooling within the wellbore 210. For example, as the fluid enters the wellbore 210 the fluid may expand causing the area around the fluid inflow to cool. The temperature profile 400 may be separated into three different sections. The first section may be the fully permeable region 402. The fully permeable region 402 may be defined by the lowest temperature in the temperature profile 400. The temperature in the fully permeable region 402 may be substantially constant. The fully permeable region 402 may correspond to the areas where the wellbore 210 is completely surrounded by the porous formation sections 204. Thus, the fully permeable region 402 may be the area where fluid is flowing into the wellbore 210 from all sides of the wellbore 210.

The second section may be the intermediate region 404. The intermediate region 404 may be characterized by a changing temperature. The intermediate region 404 may correspond to the portion of the wellbore 210 that is partially in the porous formation sections 204 and partially in the non-porous formation sections 206. Thus, the temperature in the intermediate region 404 may correspond to a ratio of the portion of the wellbore 210 that is in the porous formation sections 204 and the portion of the wellbore 210 that is in the non-porous formation sections 206. For example, a section of the wellbore 210 where a greater portion of the wellbore 210 is in the porous formation sections 204 may have a cooler temperature than a section of the wellbore 210 where the greater portion of the wellbore 210 is in the non-porous formation sections 206 because the section with a greater portion in the porous formation sections 204 may experience a greater amount of local cooling than the section that has a greater portion in the non-porous formation sections 206.

The third section may be the impermeable region 406. The impermeable region 406 may be defined by the highest temperature in the temperature profile. Similar to the fully permeable region 402 the temperature in the impermeable region 406 may be substantially constant. The impermeable region 406 may correspond to the areas where the wellbore 210 is completely surrounded by the non-porous formation sections 206. The lack of fluid flowing into the wellbore 210 in the impermeable region 406 may result in the higher temperatures.

Now referring to FIG. 3 and FIG. 4, the sensors 302 may be arranged radially about the drill string 208 as described above. The sensors 302 may detect different temperatures responsive to the proximity to the porous formation sections 204 and the non-porous formation sections 206 respectively. For example, in the embodiment illustrated in FIG. 3, the sensor 302 at the bottom of the 208 may read the lowest temperature of the four sensors 302 because the bottom sensor is the greatest distance from the non-porous formation sections 206. The two sensors 302 on the sides of the drill string 208 near the border between the porous formation sections 204 and the non-porous formation sections 206 may read a low temperature because the two sensors 302 are near enough to the porous formation sections 204 that fluid may still flow into the wellbore 210 near the two sensors 302. The top sensor 302 may read the highest temperature because the top sensor is a greater distance from the porous formation sections 204 than any of the other three sensors 302.

In some embodiments, the readings from the sensors 302 may be processed by a computing device as described above. The computing device may provide a temperature profile to the operator. The operator may redirect the drill string 208 toward the sensor 302 with the lowest temperature reading. The operator may continue to make adjustments to the direction of the drill string 208 until each of the sensors 302 read substantially the same temperature. When each of the sensors 302 read substantially the same temperature, it may indicate that each of the sensors 302 have substantially the same amount of fluid inflow in the respective regions around each of the sensors 302.

In some embodiments, the computing device may be configured to provide instructions to a steering apparatus of the drill string 208. The computing device may process the readings from each of the sensors 302 and instruct the steering apparatus to direct the drill string 208 in a direction of the sensor 302 having the lowest temperature reading. Similar to the operator, the computing device may continue to instruct directional changes until all of the sensors 302 are reading substantially the same temperature.

Figure 5:
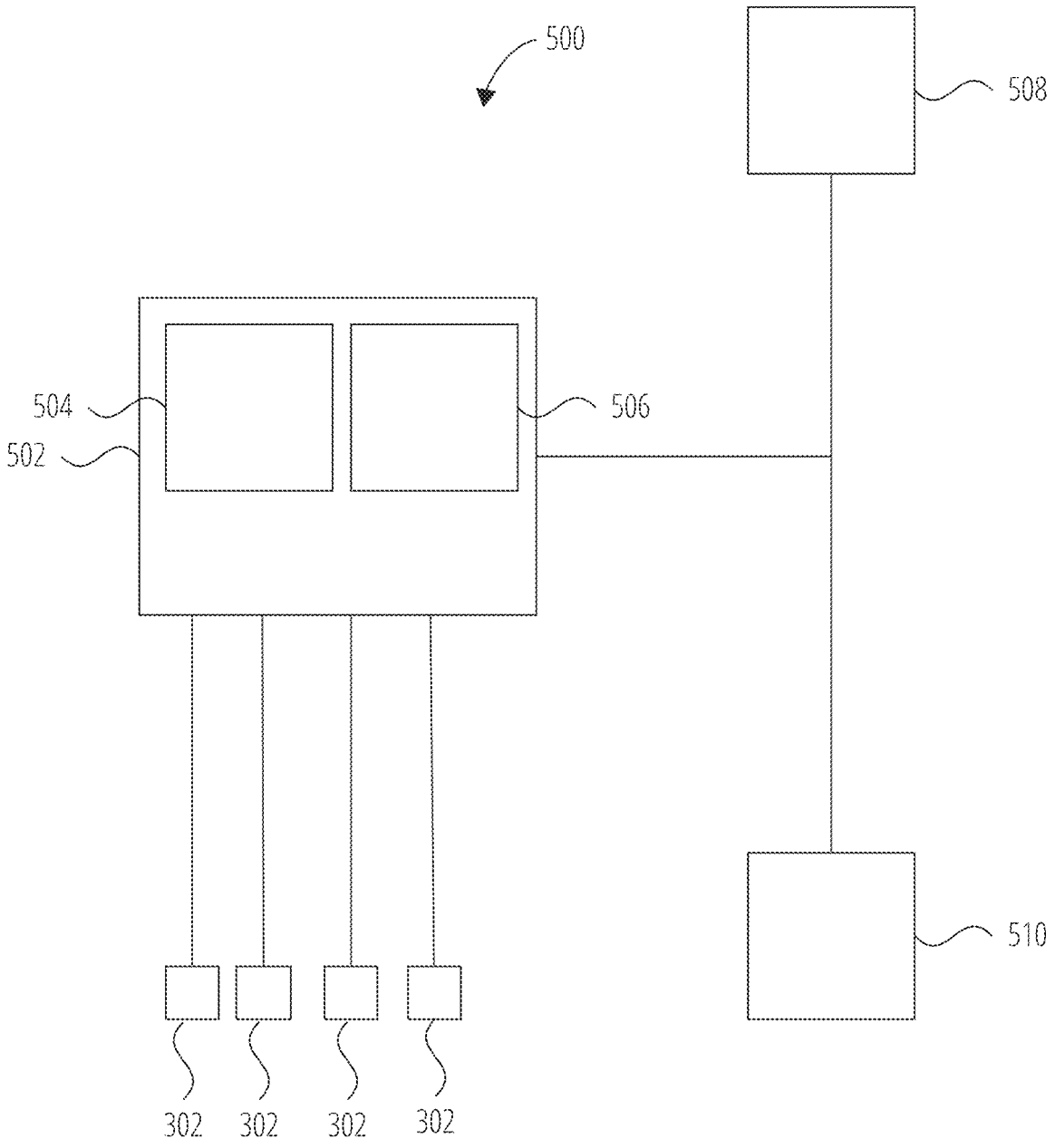
FIG. 5 illustrates a schematic view of an earth-boring system according to an embodiment of the present disclosure.

FIG. 5 illustrates an embodiment of a geo-steering system 500 for a drill string. The geo-steering system 500 may include a computing device 502 having a memory device 504 and a processor 506. In some embodiments, the memory device 504 may be configured to store instructions configured to control the processor 506. In some embodiments, the memory device 504 may be configured to store data collected by the computing device 502. The computing device 502 may be coupled to one or more sensors 302. As described above, the sensors 302 may be acoustic sensors or temperature sensors. As described above with respect to FIG. 3, the sensors 302 may be arranged radially about the drill string 208. The memory device 504 may store a location associated with each of the sensors 302, such as top, bottom, right, and left. In some embodiments, the position of each of the sensors 302 may be defined by an angular offset from a reference point, such as a line between the center of the drill string 208 and a top point of the drill string 208, such that a sensor 302 located on a bottom of the drill string 208 may be defined at a position of 180 degrees.

The processor 506 may process the readings from the sensors 302. For example, the sensors 302 may transmit the readings to the processor 506. In some embodiments, the processor 506 may store the readings in the memory device 504 matched to the respective sensor locations. In some embodiments, the processor 506 may compare readings from each of the sensors 302 to the other sensors 302. For example, the processor 506 may determine a maximum, a minimum, average, mean, etc.

The computing device 502 may be configured to transmit the data collected from the sensors 302 to an operator interface 508. In some embodiments, the operator interface 508 may be directly coupled to the computing device 502. In some embodiments, the operator interface 508 may be a remote operator interface 508 connected through a network connection, a wireless connection, a cloud connection, etc. In some embodiments, the computing device 502 may be configured to display the sensor readings and/or processed data on the operator interface 508. In some embodiments, the operator interface 508 may be configured to provide the operator with raw data such as temperature and/or noise readings for each of the sensors 302. In some embodiments, the operator interface 508 may be configured to display a model of the drill string 208 with high flow and low flow regions identified responsive to the readings from each of the sensors 302. In some embodiments, the operator interface 508 may provide a graphical display of the sensor readings, such as a temperature profile or a noise profile. For example, the profile may be illustrated with a color gradient and/or a curve fit to the individual data points on a coordinate system.

In some embodiments, the drill string 208 may have multiple arrays of sensors 302 located at different points axially along the drill string 208. For example, each array may include multiple sensors 302 arranged radially about the drill string 208 as illustrated in FIG. 3. Each array may be positioned an axial distance from an adjacent array along the drill string 208, such that measurements of the wellbore conditions may be taken at multiple different locations along the drill string 208 as described above. The computing device 502 may provide data relating to the different array locations 216 (FIG. 2) for each of the sensors 302. For example, the computing device 502 may generate an axial profile (e.g., a temperature profile or a noise profile) along the length of the drill string 208, such as the temperature profile 400 illustrated in FIG. 4. In some embodiments, the axial profile may be generated for each sensor position in the arrays, such as a profile for each bottom sensor or each top sensor, etc. In some embodiments, the axial profile may be generated for a statistical property of the arrays, such as an average temperature of each array, a maximum temperature of each array, etc. The axial profile may enable an operator to identify transition points (e.g., where the drill string 208 passes from porous formation sections 204 to non-porous formation sections 206 or from non-porous formation sections 206 to porous formation sections 204).

In some embodiments, the operator may use the information provided by the computing device 502 to control the direction of the 208 through the operator interface 508 and a steering apparatus 510. In some embodiments, the computing device 502 may directly control the steering apparatus 510 responsive to the sensor readings and the operator may have override capability through the operator interface 508. The operator and/or the computing device 502 may control the steering apparatus 510 to direct the drill string 208 in a direction toward the sensor 302 with a reading that indicates the highest flow properties. For example, if the sensors 302 are temperature sensors the steering apparatus 510 may be controlled to direct the drill string 208 toward the sensor 302 with the lowest temperature reading. If the sensors 302 are acoustic sensors the steering apparatus 510 may be controlled to direct the drill string 208 toward the sensor 302 reading a frequency in or near a desirable range, such as the range for regular flow between about 5 kHz and about 20 kHz.

Figure 6:
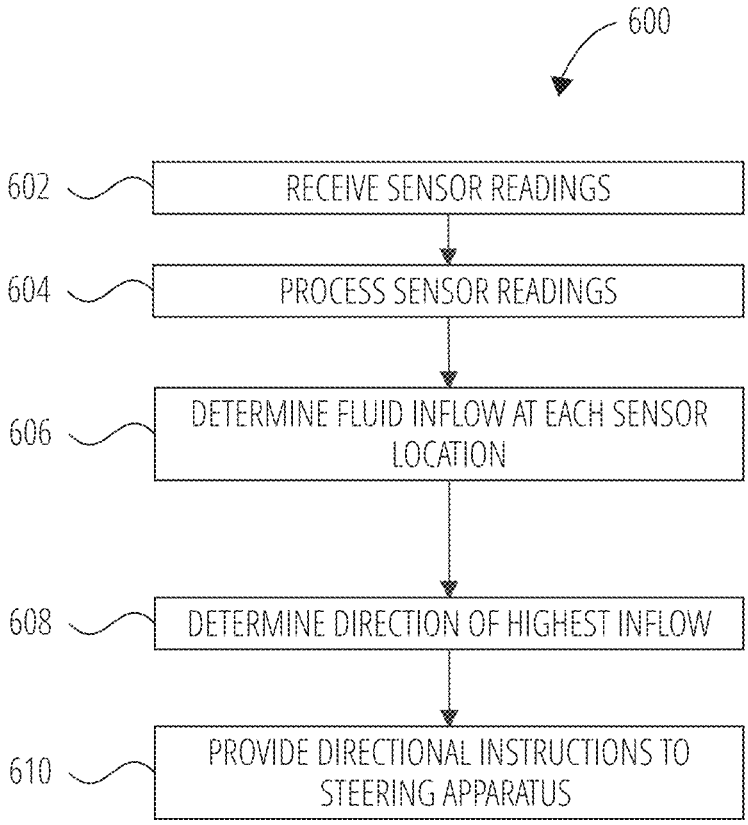
FIG. 6 illustrates a flow chart representing an embodiment of a method of geo-steering an earth-boring system in accordance with the present disclosure.

FIG. 6 illustrates a flowchart representative of a geo-steering process 600. Referring also to FIGS. 2-5. As described above, the drill string 208 may include an array of sensors 302. The sensors 302 may be configured to detect characteristics of the wellbore 210 such as temperature or noise within the wellbore 210. As described above, the characteristics of the wellbore 210 may indicate if fluid is flowing into the wellbore in the area around each of the sensors 302.

The sensor readings may be received in act 602. In some embodiments, the sensor readings may be received by a computing device 502. In some embodiments, the sensor readings may be received by an operator interface 508. In some embodiments, the sensor readings may pass through the computing device 502 to the operator interface 508. For example, the computing device 502 may store the sensor readings in a memory device 504 in the computing device 502 and transmit the sensor readings to the operator interface 508. In some embodiments, the operator interface 508 may provide the sensor readings to an operator. For example, the sensor readings may be displayed for the operator, printed into a spreadsheet, displayed in a database, displayed graphically (e.g., plotted on a coordinate system, displayed in a color gradient, etc.).

The sensor readings may then be processed in act 604. For example, the computing device 502 may include a processor 506 configured to make decisions and/or change instructions responsive to the sensor readings. In some embodiments, the processor 506 may arrange the sensor readings in the memory device 504 according to a location of each of the sensors 302. In some embodiments, the processor 506 may make decisions such as whether to perform further evaluation of the sensor readings from an array of sensors 302. In some embodiments, the computing device 502 may transmit the raw sensor reading data to the operator interface 508, and the sensor readings may be processed by the operator interface 508 or by an operator. In some embodiments, the computing device 502 or the operator interface 508 may determine statistical properties of each array of sensors 302. For example, the computing device 502 or the operator interface 508 may determine average values of the sensors 302 in each array, maximum values of the sensors 302 in each array, minimum values of the sensors 302 in each array, etc.

In some embodiments, the drill string 208 may include multiple arrays of sensors 302 at different array locations 216 along the drill string 208. In some embodiments, processing the sensor readings may include determining critical locations for performing additional calculations. For example, the statistical properties of each array may be evaluated. The statistical properties of each array may indicate transition points in the formation such as where the drill string 208 passes from porous formation sections 204 to non-porous formation sections 206 or from non-porous formation sections 206 to porous formation sections 204. For example, a change in the average readings between two adjacent arrays of sensors 302 may indicate that the drill string 208 passed through a transition point between the two adjacent arrays. Accordingly, the computing device 502, operator interface 508, or operator may identify a critical point between the two adjacent arrays of sensors 302. Thus, further steering decisions may be made responsive to the two adjacent arrays of sensors 302 surrounding the critical point. In some embodiments, the readings of all sensors 302 in all of the arrays of sensors 302 may be used to make steering decisions, and the arrays of sensors 302 nearest the identified critical point may be afforded greater weight. In some embodiments, the readings of all sensors 302 in all of the arrays of sensors 302 may be used to make steering decisions regardless of the proximity to a critical point. In some embodiments, the readings of the arrays of sensors 302 nearest the earth-boring tool 202 may be afforded greater weight.

In some embodiments, processing the sensor readings may include generating profiles for the drill string or sensor arrays. For example, a profile similar to the temperature profile 400 illustrated in FIG. 4 may be generated responsive to the statistical properties of the arrays of sensors 302. In some embodiments, a profile for each array of sensors 302 may be generated. For example, the profile may indicate the locations of each of the sensors 302 about the drill string 208 and a relationship between the readings of each of the sensors 302. In some embodiments, the profile may include a plot of the values on a coordinate system, such as a Cartesian coordinate. In some embodiments, the profile may include a color gradient between a low sensor reading and a high sensor reading. The profile may enable an operator to visually identify a critical point, high flow region, low flow fluid inflow region 212, fluid blockage region 214, etc.

The fluid inflow at each of the sensors 302 may be determined in act 606. In some embodiments, the fluid inflow determination may be limited to arrays of sensors 302 at or near an identified critical point, as described above. Determining the fluid inflow may include making a determination of a flow relationship between one or more sensors 302 in each array. For example, determining the fluid inflow may include determining which sensor is near the largest amount of fluid inflow and/or which sensor is near the least amount of fluid inflow. In some embodiments, the sensor readings may indicate a relational amount of fluid inflow but may not measure the amount of fluid inflow. Thus, determining the fluid inflow at each of the sensors 302 may include comparing the sensor readings of each sensor in the array and determining which sensor reading indicates a higher rate of flow. The sensor readings may be provided to the computing device 502, operator interface 508, or an operator as a value indicating the relationship between each sensor and the other sensors 302 in the associated sensor array. Thus, the determination may be between a maximum flow and a minimum flow responsive to the sensor readings. In some embodiments, the determination may be a binary determination. For example, the determination may determine if flow is present at each of the sensors 302 and produce an affirmative or negative result (e.g., yes or no, present or not present, 1 or 0, etc.) for each of the sensors 302.

After determining the fluid inflow at each of the sensors 302, the direction of the highest inflow may be determined in act 608. For example, the sensor readings may be compared as described above to determine which sensor is proximate the highest fluid inflow into the wellbore 210. In some embodiments, the direction of the highest inflow may be determined responsive to a concentration of sensors 302 indicating flow. For example, if several adjacent sensors 302 in the array indicate flow either as a percentage of flow, comparative flow, or binary flow, the direction of the highest flow may be determined to be in a direction substantially in the same direction of the several adjacent sensors.

In some embodiments, multiple concentrations of flow may be identified. For example, sensors 302 on opposing sides of the drill string 208 may indicate flow. In some embodiments, the multiple concentrations of flow may be considered to be substantially uniform, such that it may be determined that the wellbore 210 is substantially encompassed by the porous formation sections 204. In some cases, the multiple concentrations of flow may be in different locations on a same side of the drill string 208. The direction of the highest flow may thus be determined to be on the side of the drill string 208 where the multiple concentrations of flow are detected. In some embodiments, the multiple concentrations of flow may be evaluated to determine which concentration is experiencing a higher amount of flow. For example, if one concentration of sensors have readings indicating a larger amount of flow, such as lower temperatures, frequencies within the regular flow range, more positive flow identifications, etc., the highest inflow may be determined to be in the direction of the concentration of sensors experiencing higher flow.

When a direction of the highest fluid inflow is identified, instructions may be provided to the steering apparatus 510 in act 610. The instructions may be provided by the operator, the operator interface 508, or the computing device 502. In some embodiments, the steering apparatus 510 may be directed toward the highest fluid inflow as identified in act 608. In some cases, the steering apparatus 510 may be instructed to maintain the current trajectory. For example, if a substantial majority of the sensors 302, such as greater than about 80% of the sensors 302, greater than about 90% of the 302, or all of the 302, are indicating fluid inflow the direction of the drill string 208 may be maintained as the wellbore 210 may be substantially encompassed by a porous formation sections 204. In some embodiments, if one or more of the sensors 302 indicate a substantially higher flow than other sensors 302, the instructions may direct the steering apparatus 510 to adjust the direction of the drill string 208 toward the sensors 302 indicating substantially more flow.

In some cases, the steering apparatus 510 may be instructed to maintain the current trajectory when a profile of the array locations 216 indicate that the drill string 208 is passing through a transition between a non-porous formation section 206 and a porous formation section 204 such that the wellbore 210 will be substantially encompassed by the porous formation section 204. In some cases, the sensor readings may indicate that the wellbore 210 is on a border between a porous formation section 204 and a non-porous formation section 206. For example, as illustrated in FIG. 3, sensors 302 on one side of the drill string 208 may indicate flow and sensors 302 on an opposite side of the drill string 208 may indicate no flow. The instructions may direct the steering apparatus 510 to adjust the drill string 208 in a direction toward the sensors 302 that are indicating flow.

Embodiments of the present disclosure may enable an underbalanced drilling operation to determine if fluid is flowing into a wellbore without requiring an imaging sensor to be rotated within the wellbore. Determining if fluid is flowing without rotating an imaging sensor may enable non-rotating drill strings such as coil tube drill strings to be used in underbalanced drilling operations while still measuring fluid inflow downhole. Measuring fluid inflow downhole may enable a drilling operation to utilize geo-steering to position a resulting wellbore in more beneficial locations within the formation, such as porous formations, high production formations, etc.

Embodiments of the present disclosure may enable an operator or drilling system to direct a drill string in an underbalanced drilling operation into higher production portions of a formation. Increasing production of a wellbore in an underbalanced drilling operation may increase a profitability of the wellbore. Geo-steering a drill string in an underbalanced drilling operation may also enable the operator and/or drilling system to position the drill string and resulting wellbore in beneficial formations, such as high producing formations, easier to drill formations, etc. Geo-steering may enable a drill string to operate at an increased rate of penetration and/or increased production level.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A drill string, comprising:

an earth-boring tool;

a steering component configured to change a direction of advancement of the earth-boring tool;

a first array of acoustic sensors arranged about the drill string in a first axial position in a region of the drill string above the earth-boring tool; and wherein the drill string is configured to be inserted into a wellbore, and the first array of acoustic sensors is configured to detect an inflow of fluid into the wellbore from a subterranean formation; and a computing device configured to determine a position of the inflow of fluid relative to the drill string based on signals from the first array of acoustic sensors and cause the steering component to change the direction of advancement of the earth-boring tool and the drill string toward the position of the inflow of fluid.

2. The drill string of claim 1, wherein the first array of acoustic sensors comprises three or more acoustic sensors.

3. The drill string of claim 2, wherein the first array of acoustic sensors comprises four or more acoustic sensors.

4. The drill string of claim 1, wherein the first array of acoustic sensors are substantially equally spaced about the drill string.

5. The drill string of claim 4, wherein each sensor of the first array of acoustic sensors are configured to detect the inflow of fluid into the wellbore from a region of the subterranean formation in a direction substantially the same as a position of the sensor with respect to the drill string, wherein the position of the sensor is defined by an angular offset from a radial line from the center of the drill string.

6. The drill string of claim 1, further comprising a second array of acoustic sensors arranged about the drill string at a second axial position along the drill string, wherein the second axial position is different than the first axial position.

7. The drill string of claim 1, wherein the drill string comprises a coiled tubing drill string.

8. An earth-boring system, comprising:

a drill string;

an earth-boring tool coupled to the drill string;

a steering component coupled to the drill string, the steering component configured to change a direction of advancement of the earth-boring tool and the drill string;

an array of temperature sensors coupled to the drill string, wherein each temperature sensor of the array of temperature sensors is in substantially the same axial position along the drill string; and a computing device configured to receive sensor readings from the array of temperature sensors; and wherein the earth-boring tool and the drill string are configured to be inserted into a wellbore, and the computing device is configured to determine fluid inflow into the wellbore and a position of the fluid inflow responsive to the sensor readings from the array of temperature sensors and cause the steering component to change the direction of advancement of the earth-boring tool and the drill string toward the position of the fluid inflow.

9. The earth-boring system of claim 8, wherein the array of temperature sensors are arranged about the drill string.

10. The earth-boring system of claim 9, wherein the array of temperature sensors comprises at least three temperature sensors.

11. The earth-boring system of claim 10, wherein the at least three temperature sensors are arranged at substantially equal displacement angles from adjacent temperature sensors.

12. The earth-boring system of claim 8, wherein the computing device is configured to determine an increase in fluid inflow into the wellbore responsive to a lower temperature reading by at least one temperature sensor of the array of temperature sensors.

13. The earth-boring system of claim 8, wherein the computing device is configured to generate a temperature profile from the sensor readings of the array of temperature sensors.

14. The earth-boring system of claim 8, further comprising a plurality of arrays of temperature sensors coupled to the drill string at different axial positions along the drill string.

15. The earth-boring system of claim 14, wherein the computing device is configured to generate a temperature profile of the wellbore from an average temperature reading of each of the plurality of arrays of temperature sensors.

16. A method of forming a wellbore in a subterranean formation, comprising:

advancing a drill string into the wellbore, the drill string comprising an array of sensors coupled to the drill string, wherein each sensor of the array of sensors is in substantially the same axial position along the drill string;

detecting fluid inflow into the wellbore through a change in one or more properties of an environment of the wellbore detected using the array of sensors coupled to the drill string;

determining a position of the fluid inflow into the wellbore using the array of sensors coupled to the drill string; and steering the drill string in a direction toward the position of the fluid inflow into the wellbore.

17. The method of claim 16, wherein detecting the fluid inflow into the wellbore comprises detecting a change in temperature in the wellbore.

18. The method of claim 16, wherein detecting the fluid inflow into the wellbore comprises detecting an acoustic signal in the wellbore.

19. The method of claim 18, wherein the acoustic signal has a frequency greater than about 1 kilohertz (kHz).

20. The method of claim 16, wherein the array of sensors comprises an array of at least three sensors configured to detect the change in the one or more properties of the environment of the wellbore, the at least three sensors being arranged about the drill string and spaced at substantially equal displacement angles, and wherein determining a position of the fluid inflow into the wellbore comprises determining a position of a sensor of the at least three sensors that detects the fluid inflow.

* * * * *